United States Patent [19]

Fleming

[11] Patent Number: 4,512,512

[45] Date of Patent: Apr. 23, 1985

[54] FAST FOOD SERVING TRAY

[75] Inventor: James W. Fleming, Vancouver, Canada

[73] Assignee: Lawson & Jones Limited, Mississauga, Canada

[21] Appl. No.: 569,770

[22] Filed: Jan. 10, 1984

[51] Int. Cl.[3] ..... B65D 5/36

[52] U.S. Cl. ..... 229/30; 229/15; 206/563; 206/229

[58] Field of Search ..... 229/30, 15; 206/557, 206/558, 562, 563

[56] References Cited

U.S. PATENT DOCUMENTS

| | | | |
|---|---|---|---|
| D. 24,452 | 7/1895 | Saalbach . | |
| D. 88,269 | 11/1932 | Taylor . | |
| D. 164,077 | 7/1951 | Wendell . | |
| D. 199,205 | 9/1964 | Prestigiacomo . | |
| D. 209,628 | 12/1967 | Burnsworth . | |
| 1,811,478 | 6/1931 | Seckendorf | 229/30 |
| 2,875,940 | 3/1959 | Dunn | 229/30 |
| 3,499,595 | 3/1970 | Brooks | 229/30 |
| 3,722,781 | 3/1973 | Page et al. | 229/30 |
| 3,844,471 | 10/1974 | Hind | 229/30 |
| 4,219,144 | 8/1980 | Hagelberg | 229/30 |
| 4,278,197 | 7/1981 | Scheinbaum et al. | 229/30 |

FOREIGN PATENT DOCUMENTS

| | | | |
|---|---|---|---|
| 2802385 | 7/1979 | Fed. Rep. of Germany | 229/30 |

*Primary Examiner*—Joseph Man-Fu Moy
*Attorney, Agent, or Firm*—Laubscher, Philpitt & Laubscher

[57] ABSTRACT

A fast food serving tray having the shape of a ship or boat is formed from a rectangular cardboard blank by bending the blank along its longitudinal axis and adhesively securing connecting tabs at the ends of the tray to each other. The invention reduces the cost of production of the blank and facilitates the assembly of the tray at the time of serving the food.

16 Claims, 6 Drawing Figures

FAST FOOD SERVING TRAY

BACKGROUND OF THE INVENTION

The present invention relates to the art of fast food serving trays and in particular to a fast food serving tray having the shape of a ship or a boat. The invention is also concerned with a cardboard blank from which the fast food serving tray can be made.

As is well known, the fast food serving industry is a highly competitive field in which successful promotion may have a decisive role in the economic performance of the particular outlet. The design of fast food serving trays belong to important promotional items to be cnsidered in this industry. In general terms, a fast food serving tray has to accommodate a tray with a hamburger or the like, such tray being usually made of a plastic material and being of a rectangular or square plan. Furthermore, a cup of soft drink and a cup of coffee, together with a package of French fries belong to the usual items served on one order.

Many attempts have been made to provide fast food serving trays made from a carton blank and having the shape of a ship or a boat. It was found out that such shape is attractive to customers, particularly when its exposed sides and top are suitably provided with printed ornamentation.

Many design patents have been issued for such trays. Among these design patents, the following prior art references should be mentioned: U.S. Pat. No. D. 199,205 issued Sept. 22, 1964 (Prestigiacomo); U.S. Pat. No. D. 164,077 issued July 24, 1951 to J. J. Wendell; U.S. Pat. No. D. 88,269 issued Nov. 8, 1932 to E. E. Taylor, the last mentioned reference being concerned with a combined tray and receptacle for toilet preparations; U.S. Pat. No. D. 24,452 issued July 2, 1895 to E. Saalbach; and, finally, U.S. Pat. No. D. 209,628 issued Dec. 19, 1967 to R. E. Burnsworth, relating to an egg carton.

In order to meet all practical requirements, a fast food serving tray has not only to be attractive in appearance but has also to have several other features to which belongs an easy storage before the use, relatively inexpensive production cost of the tray and an easy assembly for the serving purpose.

The attractiveness of the boat or ship-shaped serving tray has been proven. However, the known serving trays of this shape and produced from a cardboard blank suffer from the disadvantage of a very complex blank which requires a complex tooling for the production. Furthermore, the known fast food serving trays made from a foldable blank are relatively complex to assemble. Thus, it can be said that the attractive appearance is achieved at the expense of high cost and difficult assembly of the tray into an operative state.

SUMMARY OF THE INVENTION

Accordingly, it is an object of the present invention to provide an improved fast food serving tray which would be relatively inexpensive to produce, which would be easy to store prior to use and which would be relatively easy and quick to assemble into the operative tray.

In accordance with one aspect of the present invention, a foldable blank is provided for forming a serving tray for fast food or the like, said blank including: a rectangular sheet having two straight, parallel, opposed, longitudinal side edges and two straight, parallel, opposed end edges, said side edges and said end edges being disposed at right angles relative to each other; a connecting tab section extending along and concident with each of said end edges generally the entire width of the sheet, each tab section being connected to the rest of the sheet by a first line of weakness; a generally H-shaped cut having a bar section and two leg sections, disposed centrally of the sheet and so arranged that said bar section coincides with longitudinal centreline of the sheet and is generally parallel with said side edges, while the two leg sections of the cut are generally parallel with each other and with the end edges of the sheet, said two leg sections being equidistantly spaced from the point of intersection of longitudinal and transverse centrelines of the sheet, the ends of the leg sections being each equidistantly spaced at a predetermined distance from the respective adjacent side edge, whereby a generally rectangular panel is formed at each side of the bar section; a pair of arcuate, generally parabolic line of weakness sections, one at each end of the sheet, each of said parabolic line of weakness sections extending from the ends of one of the leg sections of the "H" and having arcuate side sections symmetrical with respect to the longitudinal centreline and a peak section disposed near the respective end edge, said peak section being formed by an arcuate cut, said side sections including uncut but weakened sub-sections, whereby each arcuate line section and the associated leg section of said "H" form a generally parabolic panel narrowing in the direction away from a transverse centreline of the sheet; a longitudinal straight line of weakness at each end of the sheet, conicident with the longitudinal centreline of the sheet and extending from the point of intersection of the respective leg section with the bar section to the adjacent end edge of the sheet. Preferably, a generally circular cutout edge arranged to define the periphery of a cutout for a cup or the like is disposed centrally of each of said generally parabolic panels.

In another aspect, the present invention provides a serving tray for fast food or the like, comprising, in combination: a pair of generally upright, outwardly convexly curved side walls connected with each other at connection tabs integral with the respective side walls and end sections thereof; said side walls being further integral with a pair of transverse top walls, having a parabolic contour in plan, one top wall at each end of the tray; each top wall having a generally circular cutout formed centrally thereof, said generally circular cutouts being of the size adapted to removably receive a frustoconical container such as a plastic coffee cup or the like; said top walls having inside end edges defining two opposed sides of a central opening adapted to receive a rectangular container such as a hamburger or fish tray, the remaining opposed sides of said central opening being formed by a pair of upwardly extending generally rentangular side panel sections, each side panel section being integral with one side wall and forming a central, upwards extension of the surface thereof; said side panel sections having normally generally horizontal top edges generally coincident with a horizontal plane spaced above the said inside edges, said top edges being adapated to support a container such as a French fry container of a generally oval contour in plan.

BRIEF DESCRIPTION OF THE DRAWINGS

The invention will now be described by way of a preferred embodiment with reference to the accompanying drawings in which.

DETAILED DESCRIPTION OF PREFERRED EMBODIMENT

Figure 1:
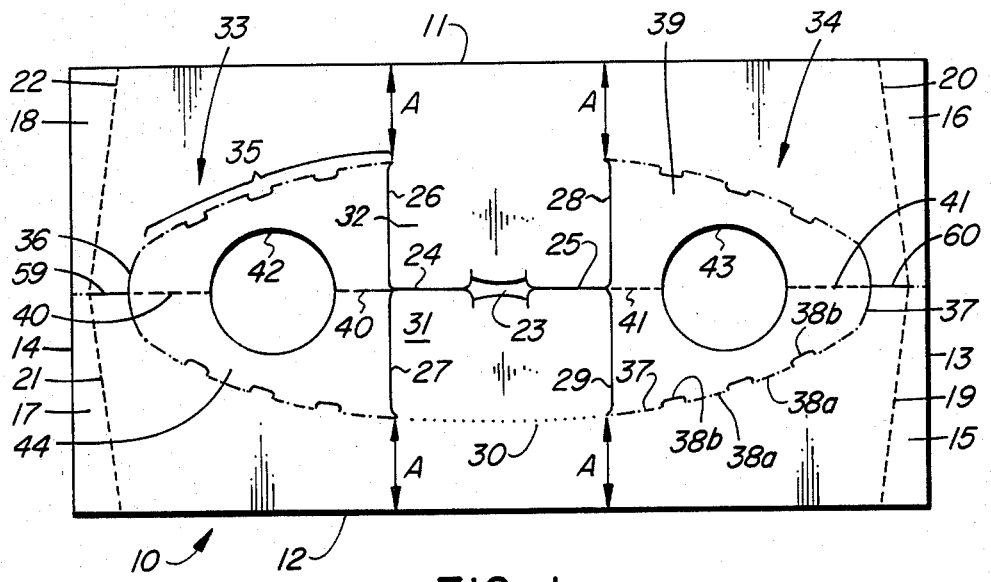
FIG. 1 is a reduced-scale view of an exemplary embodiment of a cardboard blank from which the tray is produced.

Turning firstly to the arrangement of FIG. 1, the foldable blank 10 shown in this figure is formed of a rectangular sheet which has a first straight side edge 11, a second straight side edge 12, a first straight end edge 13 and a second straight end edge 14. The side and end edges 11–14 define a rectangular structure. It will be readily appreciated that such structure is very easily and inexpensively produced with minimum waste, from a strip of cardboard or the like.

The edge 13 coincides with and forms also an edge of a connecting tab 15 and 16, while the end edge 14 is in a similar fashion conicident with a connecting tab 17 and another connecting tab 18. The connecting tabs 15, 16 form what is referred to as a "connecting tab section" while the tabs 17 and 18 form another "connecting tab section". It can be seen that each of the tab sections extends the entire width of the blank 10 i.e. from the first side edge 11 to the second side edge 12. The connecting tab 15 is connected to the rest of the sheet by a line 19 of weakness. The tab 16 is similarly connected to the rest of the blank by a line 20 of weakness and similar lines 21, 22 of weakness connect the opposite connecting tabs 17, 18 to the blank 10.

In the embodiment shown in FIG. 1, the lines 19–22 are perforated. The full lines shown in FIG. 1 identify completely cut sections or lines while the broken and dash-and-dot lines indicate a line of weakness. Those skilled in the art will appreciate that a perforation line or a line of weakness often produce generally the same result and thus can often be interchanged in a blank, without substantially modifying the features of the blank.

There is a generally H-shaped cut disposed centrally of the sheet. This refers to a structure comprising a distorted rectangular cutout 23 at the centre of blank 10 and two horizontal sections 24 and 25, one to each side of the cutout 23. The cut sections 24, 25 and the cutout 23 combine to form the bar section of the "H" as referred to above. The left hand leg section of the "H" is formed by a straight first cut 26 and straight second cut 27 which are aligned and which extend each to one side of the cut section 24, the section 24, of course, being coincident with longitudinal centreline of the rectangle of the blank 10. The right-hand leg section of the "H" is formed by a third cut 28 and by a fourth cut 29 which are again disposed to each side of the cut section 25. It is apparent from FIG. 1 that the leg sections formed by cuts 26–29 are generally straight and parallel with each other and are also parallel with the end edges 14, 13.

It is also apparent that the leg sections formed by subsections 26–29 are equidistantly spaced from an imaginary centre of the blank 10 which is defined by the intersection of the longitudinal end transverse axes of the rectangle formed by side edges 11–14.

The end of the first cut 26 (which forms the end of the respective leg) is spaced from the adjacent side edge 11 a distance A. Similarly, the free ends of each of the remaining cuts 27, 28 and 29 are spaced from their adjacent edges 11, 12, by the same predetermined distance A. If an imaginary line, such as shown by a dotted line 30 is drawn to connect the free ends of cuts 27, 29, one can see that a rectangular panel 31 is defined to the lower side of the bar section of the "H". A similar panel 32 can be shown to be present at the upper side of the bar of the "H".

The first ends of first cut 26 and second cut 27 coincide with an arcuate, generally parabolic line of weakness which is designated with reference numeral 33. A similar line of weakness is disposed to the other side of the blank of FIG. 1 and is referred to with reference numeral 34. Each of the parabolic lines of weakness 33, 34 is actually a system of combined cuts and lines of weakness as such. Therefore, it is correct to refer to each of the parabolic lines as being a "line of weakness sections". Each of these lines is formed by two arcuate side sections such as section 35. There are four sections such as section 35 and they are symmetrical with respect to the longitudinal centreline of the blank 10. A peak section 36, 37 is disposed near the respective end edge 14, 13, respectively, and is formed by an arcuate cut. The remainder of each of the parabolic lines of weakness is formed by a combination of uncut but weakened subsections such as subsections **38*a* marked at the bottom right arcuate side section, and intermediate cut subsections having generally the shape of a "U" and designated with reference numeral 38*b*. Each parabolic line 39 such as line 34 thus forms with its associated leg section of the "H" (formed by third and fourth cut 28, 29) a generally parabolic panel which narrows or converges in the direction away from a transfer centreline of the sheet, i.e. in a direction towards the adjacent end edge 13**.

A longitudinal straight line of weakness 40, 41 at each end of the sheet coincides with the longitudinal centreline of the blank 10 and extends from the point of intersection of the respective leg section (e.g. leg section formed by the first cut 26 and first cut 27) with the bar section (in the shown example with the cut section 24), to the adjacent end edge 14 of the blank. A generally circular cutout edge 42, 43 is disposed centrally of each of said generally parabolic panels 39 and 44. The cutout edge can be either of the type of a die-cut cutout as shown or, as an alternative, it can be merely a perforation line or a line of weakness arranged to allow the removal of the circular blank at the assembly stage. Accordingly, the term "cutout edge" relates to both of the above alternatives.

In a preferred embodiment, the length of each of the cuts 26, 27, 28 and 29 generally corresponds to or is only slightly more than the distance A.

It is further seen from the arrangement of FIG. 1 that the width of each of the connecting tab sections (formed by tabs 15–16 and 17–18, respectively), decreases in the direction towards the longitudinal centreline of the blank sheet 10. The tab sections formed by the connecting tabs 15, 16, 17 and 18 are provided with a coating of a pressure sensitive adhesive, on their surface turned away from the viewer of FIG. 1. In other words, the connecting tab sections are provided with an adhesive coating at one face of the sheet 10.

It is also to be noted that in the preferred embodiment, the "U"-shaped cut subsections such as subsections 38 shown at the bottom right of FIG. 1, are so arranged that their concave openings are always directed outwardly of the respective parabolic panel 39 or 44.

The blank will normally be provided with suitable ornamental printing or with other suitable surface treatment as may be desired. If the cutout edges 42, 43 are die-cut as lines of weakness or as perforation lines thus leaving circular blanks as parts of the overall blanks, the circular blanks can be lithographed to display self-contained graphics such as a gold coin imitation, thus further reducing the waste of cardboard material.

The size shown in the drawing of FIG. 1 is substantially reduced version. In actual size, the length of the end edges 13, 14 would be approximately 26 centimeters and the length would amount to approximately 53 centimeters. Those skilled in the art will readily appreciate that the blank 10 shown in FIG. 1 is a relatively inexpensive product and, above all, presents a minimum of waste of cardboard when being made from a continuous band of cardboard or the like.

Figure 2:
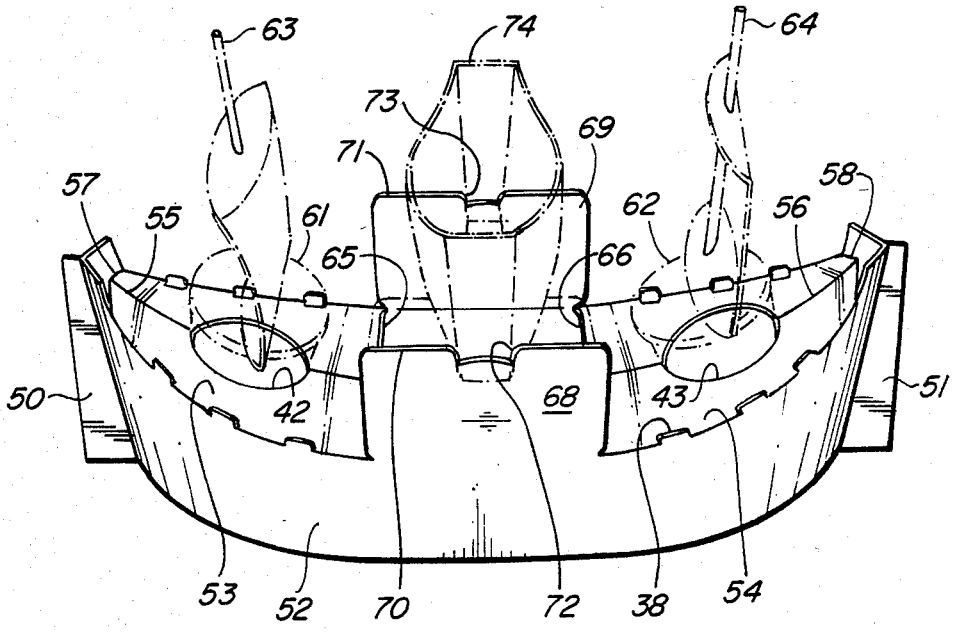
FIG. 2 is a perspective view of the tray as assembled.

The advantage of the shown arrangement is also in an easy assembly. All that is required to do with the blank as shown in FIG. 1 is to bend it generally along the longitudinal centreline of the rectangle of the blank 10. This results in that the connecting tabs 17–18 and 15–16 face each other and, eventually, can be connected by hand-applied pressure to form laminated end panels 50, 51 (FIG. 2) of the assembled tray. The arrangements of the cuts and of the lines of weaknesses results in an immediate obtaining of a three-dimensional tray resembling the shape of a ship or boat, which is shown in FIG. 2. The carton is now transformed to form a pair of generally upright, outwardly convexly curved sidewalls, of which only side wall 52 is visible in FIG. 2. The side walls are, of course, connected with each other at the end panels 50, 51 which correspond to the connection tabs 17–18 and 15–16, respectively. A pair of transfers top walls 53, 54 corresponds to the parabolic panels 44, 39, respectively. A ridge 55, 56 centrally of each of the top walls 53, 54, respectively, corresponds to the line of weakness 40, 41, respectively. On the extreme ends of each of the top walls 53, 54 is formed by an arcuate edge 57, 58 which correspond to the arcuate cuts 36, 37, respectively. The longitudinal cuts 59, 60 shown in FIG. 1 as an extension of the lines 40, 41, respectively, allow the end sections of the tray to form a generally V-shaped configuration as seen in FIG. 2 near the top of each of the end panels 50, 51.

Figure 3:
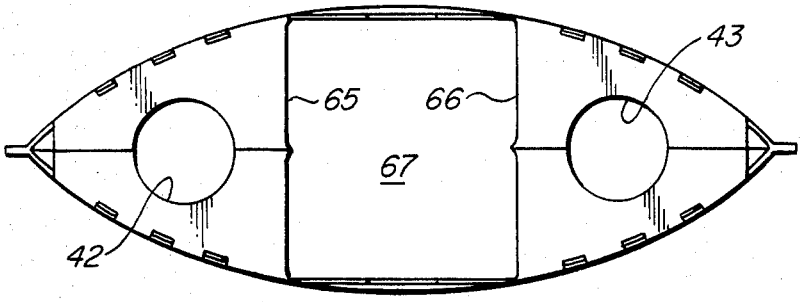
FIG. 3 is a top plan view of the tray.
Figure 4:
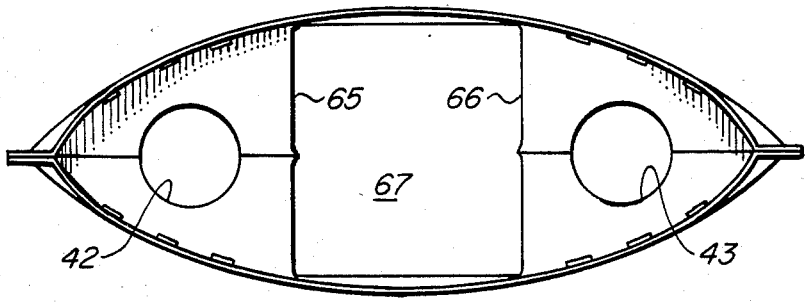
FIG. 4 is a bottom plan view of the tray.

The cutouts at cutout edges 42, 43 are each of the size capable for receiving a container such as a frusto-connical plastic coffee cup 61 or a soft drink cup 62 of generally the same configuration and size. The cups 61, 62 can be accompanied each by a straw 63, 64 which, if desired, can be each provided with a rectangular paper sheet resembling a sail. The top walls 53, 54 define inside end edges 65, 66 which correspond to the edges formed by cuts 26–27 and 28–29, respectively. The two remaining opposed sides of a central opening 67 (FIGS. 3 and 4) are formed by a pair of normally upwardly extending generally rectangular side panel sections 68, 69. The side section 68 is integral with the side wall 52 and the side sections 69 is integral with the other side wall which does not have a specific reference numeral. Each panel 68, 69 thus forms an upward extension of the surface of the respective side wall to produce a normally horizontal top edges 70, 71. The cutout 23 of the blank 10 results in a rectangular, U-shaped recess 72, 73 adapted to support a container such as a French fry container 74 shown in broken lines in FIG. 2. The central opening 67 is of a rectangular configuration (see FIGS. 3 and 4) and is adapted to receive a normally rectangular serving tray holding a hamburger or the like.

Figure 5:
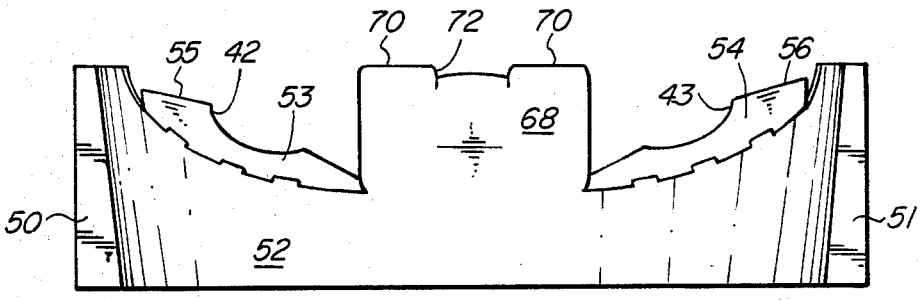
FIG. 5 is a side view of the tray.
Figure 6:
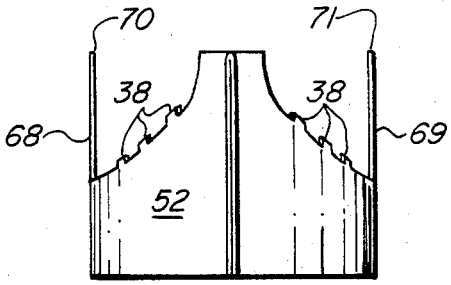
FIG. 6 is one end view thereof.

The lines of weakness 33, 34, referred to in connection with the blank in FIG. 1 are now on the sides of the tray and form joined lines between each respective side wall, e.g. side wall 52 and the associated top wall 54. The "U"-shaped cut subsections 38 now form short, upwardly turned, small rectangular protrusions visible in FIG. 2 and also in FIGS. 5 and 6.

It will be appreciated from the above that the present invention provides a relatively inexpensive fast food serving tray resembling the shape of a ship which can be easily assembled and is very economical from the standpoint of storage of the blanks prior to the assembly of the trays. The production costs are relatively low mainly due to reduced waste of cardboard material.

Many modifications of the described embodiments exist which do not depart from the scope of the present invention as recited in the accompanying claims.

I claim:

1. A foldable blank for forming a serving tray for fast food or the like, said blank including:

(a) a rectangular sheet having two straight, parallel, opposed, longitudinal side edges and two straight parallel, opposed end edges, said side edges and said end edges being disposed at right angles relative to each other;

(b) a connecting tab section extending along and coincident with each of said end edges, generally the entire width of the sheet, each tab section being connected to the rest of the sheet by a first line of weakness;

(c) a generally H-shaped cut having a bar section and two leg sections disposed centrally of the sheet and so arranged that said bar section coincides with longitudinal centreline of the sheet and is generally parallel with said side edges, while the two leg sections of the cut are generally parallel with each other and with the end edges of the sheet, said two leg sections being equidistantly spaced from the point of intersection of the longitudinal and transverse centrelines of the sheet, the ends of the leg sections being each equidistantly spaced a predetermined distance from the respective adjacent side edge, whereby a generally rectangular panel is formed at each side of the bar section;

(d) a pair of arcuate, generally parabolic line-of-weakness sections, one at each end of the sheet, each of said parabolic line-of-weakness sections extending from the ends of one of the leg sections of the "H" and having arcuate side sections symmetrical with respect to the longitudinal centreline, and a peak section disposed near the respective end edge, said peak section being formed by an arcuate cut, said side sections including uncut but weakened subsections, whereby each arcuate line section and the associated leg section of said "H" form a generally parabolic panel narrowing in the direction away from a transverse centreline of the sheet; and (e) a longitudinal straight line of weakness at each end of the sheet, conicident with the longitudinal centreline of the sheet and extending from the point of intersection of the respective leg section with the bar section to the adjacent end edge of the sheet.

2. A blank as claimed in claim 1, further comprising a generally circular cutout edge arranged to define the periphery of a cutout for a cup or the like, said cutout edge being disposed cantrally of each of said generally parabolic panels.

3. A blank as claimed in claim 2, wherein said predetermined distance between the end of each of the leg sections and the adjacent side edge generally corresponds to the distance between the respective end of the associated leg section and the bar section of the cut.

4. A blank as claimed in claim 2, wherein the width of each connecting tab section decreases in the direction towards the longitudinal centreline of the sheet.

5. A blank as claimed in claim 2, wherein the connecting tab sections are provided with an adhesive coating at one face of the sheet.

6. A blank as claimed in claim 5, wherein the adhesive is a pressure-sensitive adhesive.

7. A blank as claimed in claim 2, wherein the side sections of the arcuate line sections are formed by alternating cut and weakened subsections.

8. A blank as claimed in claim 7, wherein the cut subsections are of a generally U-shaped configuration each having a concave opening directed outwardly of the respective parabolic panel.

9. A blank as claimed in claim 2, comprising a generally rectangular cutout at the centre of the bar section of the "H".

10. A serving tray for fast food or the like, comprising, in combination, (a) a pair of generally upright, outwardly convexly curved side walls connected with each other at connection tabs integral with the respective side walls and end sections thereof;

(b) said side walls being further integral with a pair of transverse top walls, each top wall having a parabolic contour in plan, said top walls being disposed one at each end of the tray;

(c) each top wall having a generally circular cutout formed centrally thereof, said generally circular cutouts being of the size adapted to removably receive a frustoconical container such as a plastic coffee cup;

(d) said top walls having inside end edges defining two opposed ends of a central opening adapted to receive a rectangular container such as a hamburger or fish tray, the two remaining opposed sides of said central opening being formed by a pair of normally upwardly extending generally rentangular side panel sections, each side panel section being integral with one of said side walls and forming a central, upward extension of the surface thereof;

(e) each of said side panel sections having a normally generally horizontal top edge, the top edges being generally coincident with a horizontal plane spaced above the said inside end edges, said top edges being adapted to support a container such as a French fry container of a generally oval contour in plan.

11. A serving tray as claimed in claim 10, wherein the height of each side panel section generally corresponds to that of the respective side wall section at a central part thereof.

12. A serving tray as claimed in claim 10, wherein the width of each of said connection tabs increases in downward direction.

13. A serving tray as claimed in claim 10, wherein the connecting tabs at each end of the tray are adhesively secured to each other.

14. A serving tray as claimed in claim 13, wherein the connecting tabs at each end of the tray are adhesively secured to each other by a pressure sensitive adhesive.

15. A tray as claimed in claim 10, wherein the joinder between each side wall and the top walls is formed by alternating a cut and scored sections forming an arcuate joinder line.

16. A serving tray as claimed in claim 10, wherein the top edges are each provided with a generally rectangular cutout at the centre to improve the centreing of an associated French fry or the like container therein.

* * * * *